US010633849B2

(12) United States Patent
Kashirajima et al.

(10) Patent No.: US 10,633,849 B2
(45) Date of Patent: Apr. 28, 2020

(54) FLUSH TOILET HAVING A BOWL WITH A SHELF

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Yuuki Shinohara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/808,365

(22) Filed: Nov. 9, 2017

(65) Prior Publication Data

US 2018/0135290 A1 May 17, 2018

(30) Foreign Application Priority Data

Nov. 16, 2016 (JP) ..... 2016-223229

(51) Int. Cl.
*E03D 11/08* (2006.01)

(52) U.S. Cl.
CPC ..... *E03D 11/08* (2013.01)

(58) Field of Classification Search
CPC ..... E03D 11/02; E03D 11/08; E03D 11/13
USPC ..... 4/420, 420.1, 425, 428
See application file for complete search history.

(56) References Cited

U.S. PATENT DOCUMENTS

| | | | | | |
|---|---|---|---|---|---|
| 4,197,599 | A * | 4/1980 | Tsai | E03D 11/08 | 4/415 |
| 5,926,863 | A * | 7/1999 | Arita | E03D 11/06 | 4/421 |
| 6,145,138 | A * | 11/2000 | Nakamura | E03D 11/02 | 4/420 |
| 7,661,153 | B2 * | 2/2010 | Nakamura | E03D 11/08 | 4/420 |
| 8,640,272 | B2 * | 2/2014 | Morita | E03D 11/08 | 4/420 |
| 2008/0271234 | A1 * | 11/2008 | Okada | E03D 11/08 | 4/425 |

FOREIGN PATENT DOCUMENTS

| | | | | |
|---|---|---|---|---|
| GB | 2045311 | A * | 10/1980 | E03D 11/02 |
| JP | 3381261 | B2 | 2/2003 | |
| JP | 2009-097172 | A | 5/2009 | |
| WO | 98/16696 | A1 | 4/1998 | |

* cited by examiner

*Primary Examiner* — Erin Deery
(74) *Attorney, Agent, or Firm* — Studebaker & Brackett PC

(57) ABSTRACT

A flush toilet includes a shelf formed on the top edge of a bowl-shaped waste receiving surface, and a rim forming an inner wall surface rising from the outer edge of the shelf. The bowl includes a front side region and a rear side region, respectively, formed on the front side and the rear side of a center axis extending horizontally in the left-right direction so as to divide the bowl equally in the front-rear direction. The inner wall surface includes an overhang portion protruding toward inside of the bowl obliquely from the bottom end of the overhang portion. The ratio between the overhang amount and the width of the shelf is set smaller than 1.0.

6 Claims, 7 Drawing Sheets

FLUSH TOILET HAVING A BOWL WITH A SHELF

TECHNICAL FIELD

The present invention relates to a flush toilet, and more particularly to a flush toilet configured to discharge waste by flushing the flush toilet with flush water supplied from a flush water source.

BACKGROUND

As set forth, for example, in Patent Document 1 (Japanese Patent Unexamined Publication No. 2009-97172), some of the conventional flush toilets flushed with flush water supplied from a flush water source to discharge waste have, in order to increase visibility of the inner rim wall surface, the inner rim wall surface that is sloped outward from the bottom thereof toward the top thereof, or the inner rim wall surface that rises vertically.

As set forth in Patent Document 1, some of the conventional flush toilets also include the inner rim wall surface that is sloped inward from the bottom thereof toward the top thereof.

Also, as set forth in Patent Document 2 (Japanese Patent Publication No. 3381261 (WO 98/16696)), some of the conventional flush toilets include an overhang structure formed throughout the circumference of the inner wall surface of the rim, or an overhang structure formed only in a portion of the inner wall surface of the rim.

However, since the above-described conventional flush toilets have the inner rim wall surface that is sloped outward from the bottom thereof toward the top thereof or the inner rim surface that rises vertically, if a shelf is formed to cause flush water to circulate on the top edge of the bowl waste receiving surface on the flush toilets, the shelf is exposed to a user standing in front of and above the bowl.

This causes a perceptional problem in users that the users may experience a discomfort by seeing waste adhered to the shelf, and also would aesthetically degrade the appearance of the toilet.

The conventional flush toilets formed with a large overhang structure throughout the circumference of the inner wall surface of the rim have problems that the inner wall surface of the rim loses its visibility to a large extent, resulting in making clean-up work difficult.

SUMMARY

The present invention was therefore undertaken to resolve the above-described problems of the conventional art, and has the object of providing a flush toilet capable of reducing the visibility of the shelf while attaining the good visibility of the inner wall surface of the rim, thereby eliminating a user's perceptional problem that the user may experience a visual discomfort by seeing waste adhered to the shelf.

To resolve the above-described issues, the present invention provides a flush toilet configured to discharge waste by flushing the flush toilet with flush water supplied from a flush water source. The flush toilet comprises a bowl including a bowl-shaped waste receiving surface, a shelf formed on a top edge of the waste receiving surface, a connecting surface extending outward from an outer edge of the shelf, and a rim including an inner wall surface configured to rise from an outer edge of the connecting surface. The flush toilet also comprises a rim spout portion configured to spout the flush water onto the shelf in the bowl.

The bowl includes a front side region and a rear side region. The front side region is formed on a front side of a center axis extending horizontally in a left-right direction of the bowl so as to divide the bowl equally in a front-rear direction. The rear side region is formed on a rear side of the center axis.

The inner wall surface includes an overhang part configured to protrude obliquely toward inside of the bowl.

The shelf is shaped to have a width (W2) in a horizontal direction in the front side region, and the overhang part is shaped to protrude for an amount (W1) in the horizontal direction in the front side region. A ratio (W1/W2) of the overhang amount (W1) to the width (W2) is set smaller than 1.0.

According to the invention thus constituted, good visibility of the inner wall surface from a user positioned in front of and above the bowl can be attained.

Also, the outer edge of the shelf in the front side region of the bowl is made less noticeable, and thus the visibility of the shelf is effectively reduced.

Therefore waste is less prone to adhesion to the shelf, and the user's perceptional problem that the user may experience a visual discomfort can be eliminated.

In the present invention, the overhang part of the inner wall surface preferably includes a sloped surface configured to slope from the bottom end of the overhang part toward the innermost portion of the overhang part.

According to the invention thus constituted, the visibility of the inner wall surface from a user positioned in front of and above the bowl can be attained. Also, the visibility of the shelf can be more effectively reduced.

Therefore, waste is less prone to adhesion to the shelf, and the user's perceptional problem that the user may experience a visual discomfort can be eliminated.

In the present invention, the sloped surface is preferably configured to have a slope angle relative to a vertical plane. The slope angle is larger in a vicinity of a front end of the bowl than the slope angle at other locations in a circumference of the bowl.

According to the invention thus constituted, the shelf is less noticeable in the vicinity of the front end of the bowl.

Also, urine, when striking the inner wall surface in the vicinity of the front end of the bowl interior, where urine is likely to strike, can be prevented from running up the sloped surface of the overhang part of the inner wall surface and splashing outside the bowl.

In addition, since the sloped surface of the overhang part of the inner wall surface has the slope angle, which becomes largest in the vicinity of the front end inside the bowl, the sloped surface facilitates gripping of the flush toilet when the flush toilet is installed, for example, thereby improving the installability of the flush toilet.

In the present invention, the ratio (W1/W2) is preferably set to 0.2 or more and smaller than 1.0.

According to the invention thus constituted, good visibility of the inner wall surface from a user positioned in front of and above the bowl can be attained. Also, the outer edge of the shelf located in the front side region of the bowl is made less noticeable, and the visibility of the shelf can be effectively reduced.

Therefore waste is less prone to adhesion to the shelf, and the user's perceptional problem that the user may experience a visual discomfort can be eliminated.

In the present invention, the bowl comprises side regions between the front and rear side regions, and the connecting surface is preferably configured to connect the outer edge of the shelf to the bottom end of the inner wall surface of the rim by a curved surface having a curvature radius measured in a vertical plane. The curvature radius is variable along the circumference of the inner wall surface and set larger in the rear side region of the bowl than the curvature radius in the side regions of the bowl.

According to the invention thus constituted, the connecting surface (boundary) connecting between the outer edge of the shelf and the inner wall surface can be made less conspicuous in the rear side region of the bowl than in the side regions thereof from a user positioned in front and above the bowl.

Hence, the inner wall surface can be made visible in the rear side region of the bowl than in the side regions thereof.

In the present invention, the width (W2) of the shelf is set smaller in the rear side region of the bowl than the width (W2) of the shelf in the side regions of the bowl.

According to the invention thus constituted, the shelf located in the rear side region can be made less noticeable than the shelf located in the side regions from a user positioned in front of and above the bowl.

Hence, the inner wall surface of the rim can be made more visible in the rear side region of the bowl than in the side regions. Therefore, the tendency of waste prone to adhesion more to the shelf located in the rear side region than to the shelf located in the side can be suppressed, and the user's perceptional problem that the user may experience a visual discomfort can be eliminated.

In the present invention, the width (W2) of the shelf is preferably set larger in the front side region of the bowl than the width (W2) of the shelf in the side regions of the bowl.

According to the invention thus constituted, good visibility of the inner wall surface from a user positioned in front of and above the bowl can be attained. Also, the shelf can be made less visible in the front side region of the bowl than in the side regions thereof, thus reducing the visibility of the shelf.

Therefore, waste becomes less prone to adhesion to the shelf, and the user's perceptional problem that the user may experience a visual discomfort can be eliminated.

In the flush toilet of the present invention, the visibility of the shelf can be reduced while the visibility of the inner wall surface is maintained, so that the visual discomfort the user may experience by seeing waste adhered to the shelf can be eliminated.

DETAILED DESCRIPTION

Next, referring to FIGS. 1-5, a flush toilet according to the first embodiment of the invention is explained hereinafter.

Figure 1:
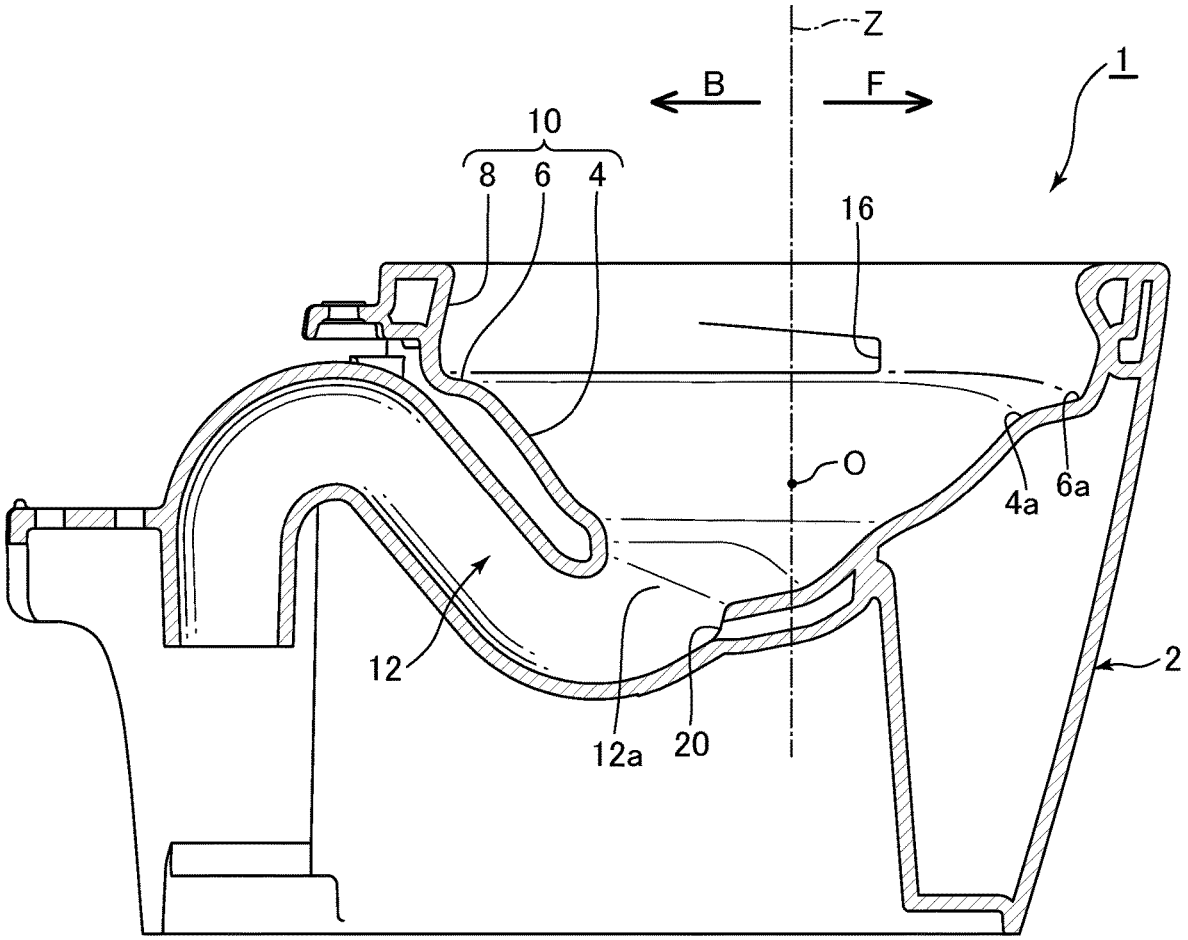
FIG. 1 is a center cross section of the main unit of a flush toilet according to the first embodiment of the invention.
Figure 2:
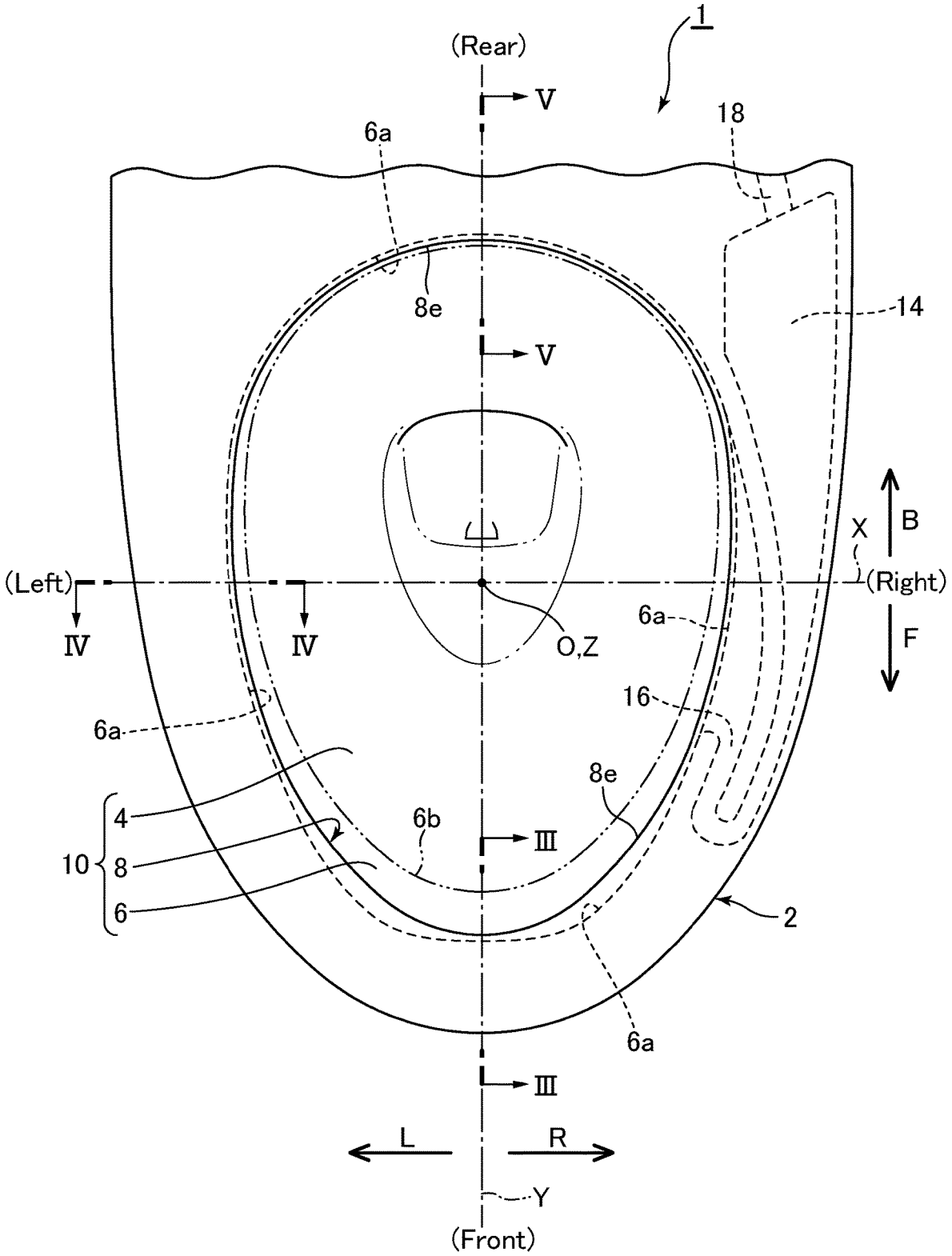
FIG. 2 is a plan view of the main unit of a flush toilet according to the first embodiment of the invention.

First, FIG. 1 is a center cross section of the main unit of the flush toilet according to the first embodiment of the invention. FIG. 2 is a plan view of the main unit of the flush toilet according to the first embodiment of the invention.

As shown in FIGS. 1 and 2, the flush toilet 1 according to the first embodiment of the invention includes a toilet main unit 2 made of ceramic. The toilet main body 2 may also be made of a material other than ceramic, such as resin.

The flush toilet 1 of the embodiment shown in FIGS. 1 and 2 has a toilet seat and lid (not shown) disposed on the top surface of the toilet main unit 2. A sanitary flush device for washing user's private parts, and other functional devices, such as a water supply system that functions to supply water to the toilet main unit 2, are installed on the rear side of the toilet seat and toilet lid. Please note that these devices are not illustrated in the drawings, and an explanation thereof is omitted.

As shown in FIGS. 1 and 2, the toilet main unit 2 includes a bowl-shaped waste-receiving surface 4, a shelf 6, a rim 8, and a bowl 10. The shelf 6 is formed around the top edge 4*a* of the waste-receiving surface 4. The rim 8 is formed so as to rise from the outer edge 6*a* of the shelf 6.

In addition, as shown in FIG. 1, the toilet main unit 2 includes a discharge trap pipe 12. An inlet 12*a* on the discharge trap pipe 12 is connected to the bottom of the bowl 10, and serves as a discharge path for discharging waste in the bowl 10.

In the plan view of the bowl 10 of the toilet main unit 2, the flush toilet 1 according to the first embodiment of the invention shown in FIGS. 1 and 2 has a center axis identified by the letter "X" that extends horizontally in the left-right direction and divides the bowl 10 into front and rear parts.

Also, the flush toilet 1 has a center axis identified by the letter "Y" that extends horizontally in the front-rear direction and divides the bowl 10 into left and right parts. In addition, the flush toilet 1 has a center axis identified by the letter "Z" that extends vertically and passes through a center O of the bowl 10.

As shown in FIG. 2, the front, rear, left, and right directions of the flush toilet 1 are respectively identified by the legends "front," "rear," "left," and "right."

And, as shown in FIGS. 1 and 2, the legends "front side region F" and "rear side region B" define the front and rear sides of the flush toilet 1, respectively, with respect to the center O, the center axis X extending horizontally in the left-right direction, and the center axis Z extending vertically of the bowl 10 of the flush toilet 1.

In addition, as shown in FIG. 2, the legends "left side region L" and "right side region R" define the left and right sides of the flush toilet 1, respectively, as seen from the front, with respect to the center O and the center axis Y extending horizontally in the front-rear direction of the flush bowl 10 of the toilet 1.

As shown in FIGS. 1 and 2, a rim conduit 14 that performs a part of the functionality of the rim spout portion is formed inside the right side region R and the front side region F of the bowl 10.

A single rim spout port 16 is formed at the downstream end of the rim conduit 14. The rim spout port 16 performs a part of the functionality of the rim spout portion by spouting flush water rearward inside the bowl 10 to form a circulating flow.

That is, the rim spout portion comprises the single rim spout port 16 disposed in the rim 8 of the bowl 10 for spouting flush water throughout the entire circumference of the rim 8. The rim spout port 16 is disposed in the rim 8 in the right side region R and in the front side region F of the bowl 10, and spouts flush water rearward.

In addition, as shown in FIG. 2, the upstream side of the rim conduit 14 is directly connected to a water conducting pipe 18. The upstream side of the water conducting pipe 18 is directly connected to a water utility pipe (not shown) that functions as a flush water source. With the piping configuration, the water supply pressure is utilized so that flush water supplied into the rim conduit 14 from the water conducting pipe 18 is directed forward within the rim conduit 14, and then guided inside and rearward over to the rim spout port 16 located downstream.

Flush water directed to the rim spout port 16 is spouted (rim spouted) toward rearward and circulated inside the bowl 10, thereby forming a circulating flow inside the bowl 10.

The flush toilet 1 of the present embodiment has been described, in which the rim conduit 14 is disposed inside the rim 8 in the right side region R of the bowl 10, and the single rim spout port 16 is opened in the inner periphery of the rim 8 in the front side region F and the right side region R of the bowl 10 as seen from the front of the toilet main unit 2. However, it is to be noted that the present invention is not limited to the described embodiment, and other variations can be adopted in which the rim conduit 14 is disposed inside the rim 8 in the left side region L of the bowl 10, and the single rim spout port 16 is opened in the inner periphery of the rim 8 in the front side region F and left side region L of the bowl 10 so as to perform spouting (rim spouting) rearward from the rim spout port 16.

As long as the single rim spout port 16 is opened in the rim 8 in the front side region F of the bowl 10, the single rim spout port 16 may be opened on either the left or right side.

In addition, as shown in FIG. 1, a jet spout port 20 is formed at the bottom portion of the bowl 10. The jet spout port 20 is directed at the inlet 12*a* of the discharge trap pipe 12. With the configuration, spouting (jet spouting) from the water supply functional portion (not shown) is also effected from the jet spout port 20.

Note that in the flush toilet 1 according to the present embodiment, rim spouting by the rim spout port 16 is performed using the water supply pressure.

Alternatively, a "hybrid" form of flush toilet may be adopted in which a pressurizing pump (not shown) for jet spouting by the jet spout port 20 is used to supply flush water from a reservoir tank (not shown). It should be noted, however, that the invention is not limited to these configurations and other variations may also be adopted. For example, jet spouting by the jet spout port 20 may be dispensed with.

Figure 3:
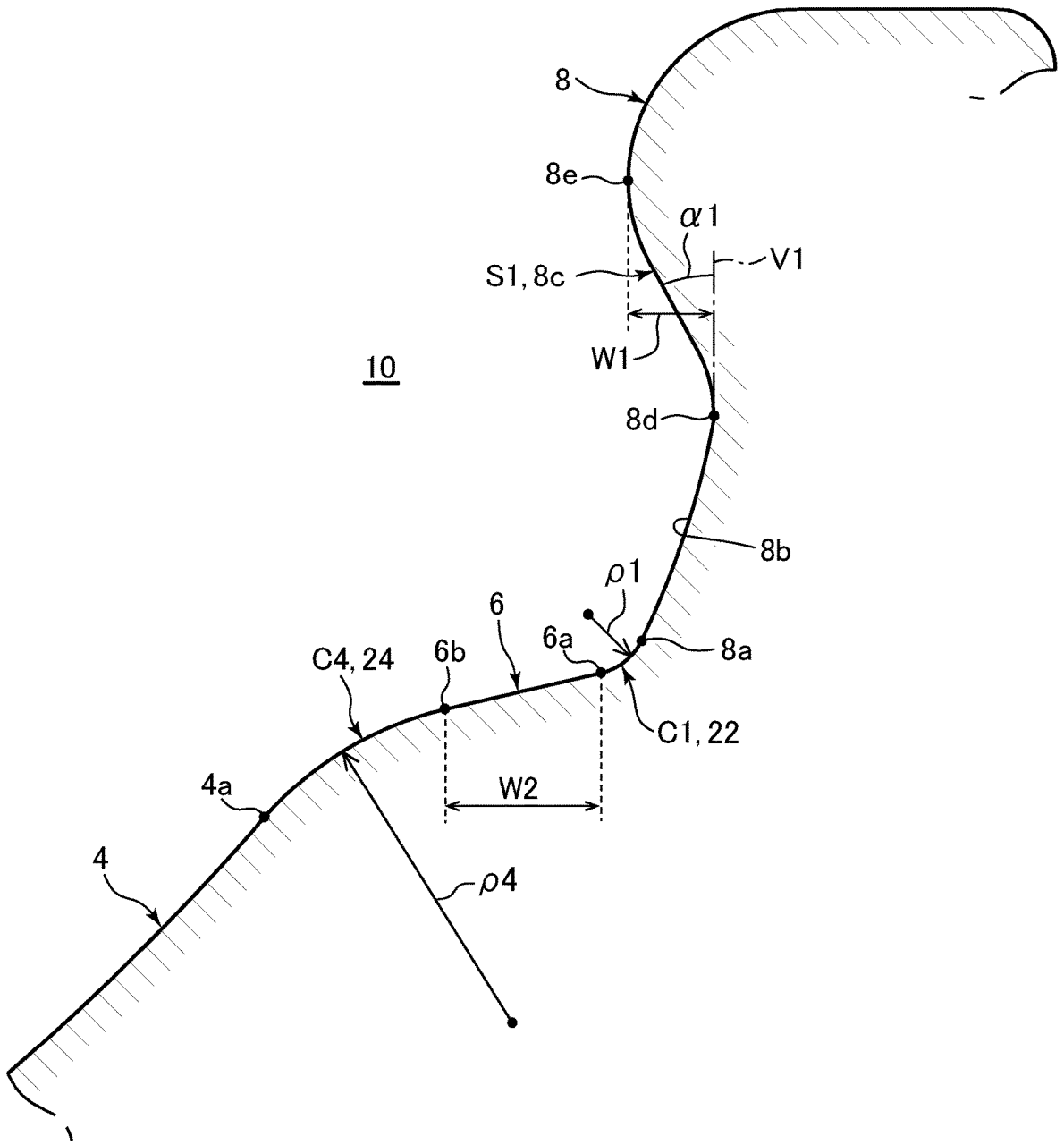
FIG. 3 is a cross section taken along line in FIG. 2.

Next, referring to FIGS. 1-5, the areas extending from the top edge of the waste receiving surface 4 of the bowl 10 through the rim 8 in the flush toilet 1 according to the first embodiment of the invention are explained in detail. FIG. 3 is a cross section taken along line in FIG. 2. That is, FIG. 3 is a cross section taken in the vicinity of the front end of the bowl 10 in the flush toilet 1 according to the first embodiment of the invention.

Figure 4:
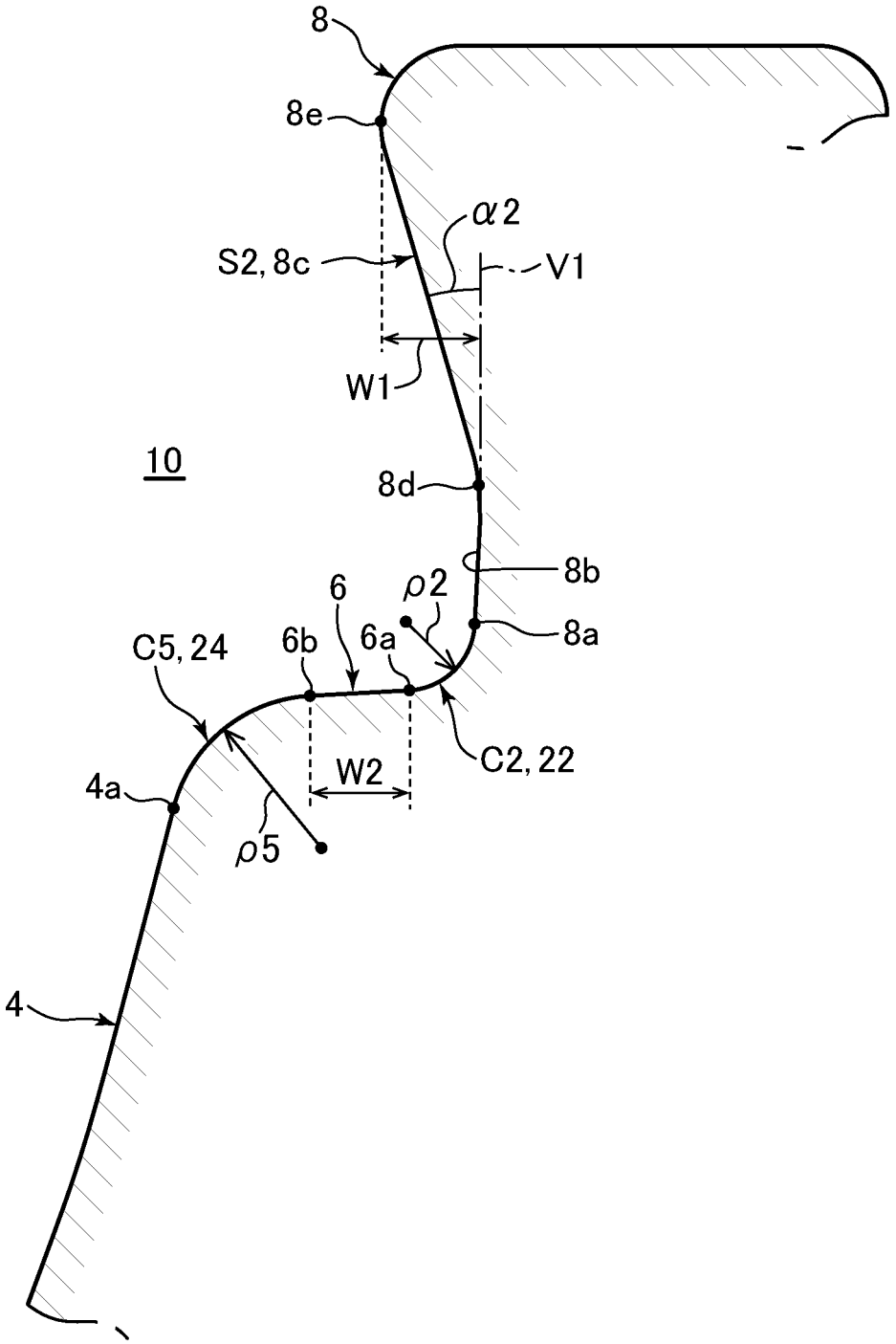
FIG. 4 is a cross section taken along line IV-IV in FIG. 2.

FIG. 4 is a cross section taken along line IV-IV in FIG. 2. That is, FIG. 4 is a cross section taken in the vicinity of the left edge of the bowl 10 in the flush toilet 1 according to the first embodiment of the invention.

Figure 5:
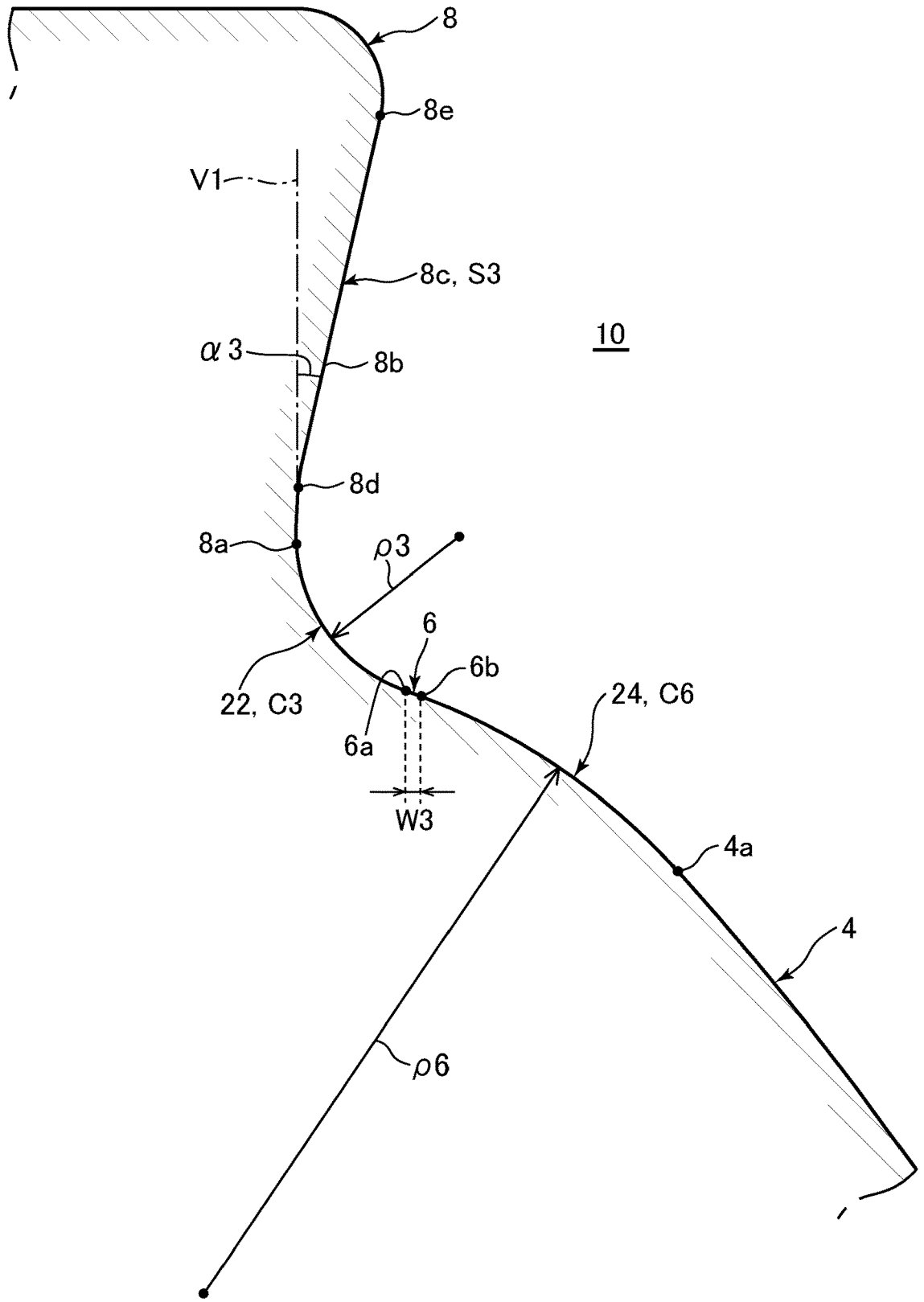
FIG. 5 is a cross section taken along line V-V in FIG. 2.

In addition, FIG. 5 is a cross section taken along line V-V in FIG. 2. That is, FIG. 5 is a cross section taken in the vicinity of the rear edge of the bowl 10 in the flush toilet 1 according to the first embodiment of the invention.

As shown in FIGS. 3-5, the bowl 10 includes outer connecting surfaces 22 extending from the outer edge 6*a* of the shelf 6 toward the outside. The outer connecting surfaces 22 are configured to form curved surfaces C1, C2, and C3, respectively, which each connect between the outer edge 6*a* of the shelf 6 and the bottom end 8*a* of the rim 8. The inner wall surface 8*b* of the rim 8 is formed so as to rise from the outer edge of the outer connecting surface 22.

Similarly, the bowl 10 includes inner connecting surfaces 24. The inner connecting surfaces 24 are configured to form curved surfaces C4, C5, and C6, respectively, which each connect the top edge 4*a* of the waste receiving surface 4 and the inner edge 6*b* of the shelf 6.

As shown in FIG. 2, the outer edge 6*a* of the shelf 6 in the front side region F and the right side region R of the bowl 10 is positioned further to the inside of the bowl 10 than the rim spout port 16, and is substantially symmetrical in the left-right direction to the outer edge 6*a* of the shelf 6 located in the front side region F and the left side region L of the bowl 10.

As shown in FIGS. 3-5, the rim 8 comprises the inner wall surface 8*b* rising from the bottom end 8*a* thereof. The inner wall surface 8*b* includes an overhang part 8*c* protruding toward inside the bowl 10 upwardly from the bottom end thereof.

As shown in FIGS. 3 and 4, the bottom end of the overhang part 8*c* in the front side region F of the bowl 10 will be referred to as an "overhang bottom end 8*d*." The inner edge of the overhang part 8*c* protruding further to the inside of the bowl 10 than the bottom end 8*d* thereof will be referred to as an "overhang inner edge 8*e*." In an embodiment, an amount W1 of the horizontal overhang measured from the bottom end 8*d* of the overhang part 8*c* to the inner edge 8*e* thereof in the vicinity of the front end of the front side region F of the bowl 10 shown in FIG. 3 is set, for example, equal to 10 mm.

Similarly, an amount W1 of the horizontal overhang measured from the bottom end 8*d* of the overhang part 8*c* to the inside edge 8*e* thereof in the vicinity of the left end of the front side region F of the bowl 10 shown in FIG. 4 is set, for example, equal to 10 mm. On the other hand, a width W2 of the horizontal shelf measured from the inner edge 6*b* to the outer edge 6*a* of the shelf 6 at the front end of the front side region F in the bowl 10 shown in FIG. 3 is set, for example, equal to 20 mm. A with W2 of the horizontal shelf measured from the inner edge 6*b* to the outer edge 6*a* of the shelf 6 in the vicinity of the left end of the front side region F in the bowl 10 shown in FIG. 4 is set, for example, equal to 10 mm.

Therefore, the ratio W1/W2 of the overhang amount W1 measured in the vicinity of the front end of the front side region F of the bowl 10 shown in FIG. 3 to the shelf width W2 is, for example, 0.5. Also, the ratio W1/W2 of the overhang amount W1 measured in the vicinity of the left end of the front side region F of the bowl 10 shown in FIG. 4 to the shelf width W2 is, for example, 1.0.

In the present embodiment, the ratio W1/W2 between the overhang amount W1 measured at the location in the front side region F of the bowl 10 and the shelf width W2 is set preferably to 0.2 or above, for example, and equal to or less than 1.0, and most preferably to 0.3-0.7.

With the ratios, the good visibility of the inner wall surface 8*b* from a user positioned in front of and above the bowl 10 can be attained as shown in FIG. 2. Further, the outer edge 6*a* of the shelf 6 in the front side region F of the bowl 10 becomes less visible, thereby effectively reducing the visibility of the shelf 6. In addition, waste is less prone to adhesion to the shelf 6, thereby resolving the perceptional problem that the user may experience a discomfort by seeing adhered waste.

As shown in FIGS. 3-5, the overhang parts 8*c* of the inner wall surface 8*b* configured to include sloped surfaces S1-S3 sloping diagonally upward from the bottom end 8*d* thereof toward the inner edge 8*e* located inside the bowl 10.

The sloped surface S1 of the overhang part 8*c* extending around the front end of the front side region F of the bowl 10 as shown in FIG. 3 is configured so that a slope angle α1 relative to the vertical face V1 thereof becomes largest in the vicinity of the front end inside the bowl 10 among those measured around the circumference of the inner wall surface 8*b*.

That is, the slope angle α1 of the slope surface S1 of the overhang part 8*c* measured in the vicinity of the front end of the front side region F of the bowl 10 shown in FIG. 3 is set larger than a slope angle α2 (<α1) of the sloped surface S2 of the overhang part 8*c* measured in the vicinity of the left end of the front side region F of the bowl 10 shown in FIG. 4. Also, the slope angle α1 is set larger than a slope angle α3 (<α1) of the slope surface S3 of the overhang part 8*c* measured in the vicinity of the rear end of the rear side region B of the bowl 10 shown in FIG. 5.

Note that the slope angle α1 of the slope surface S1 of the overhang part 8*c* measured in the vicinity of the front end of the front side region F of the bowl 10 shown in FIG. 3 is set preferably to 5°-40°, and is most preferably set to 20°-30°.

The curved surface C3 of the outer connecting surface 22 connecting between the outer edge 6*a* of the shelf 6 and the bottom end 8*a* of the rim 8 is configured to have a curvature radius ρ3 measured in a vertical plane in the vicinity of the rear end of the rear side region B of the bowl 10 shown in FIG. 5. The curvature radius ρ3 is set larger than a curvature radius ρ2 (<ρ3) of the curved surface C2 of the outer connecting surface 22 that is measured in a vertical plane in the vicinity of the left end of the front side region F of the bowl 10 shown in FIG. 4. The curvature radii ρ2, ρ3 of the curved surfaces C2, C3 of the outer connecting surfaces 22 are thereby set larger in the rear of the bowl 10 than those measured in the sides thereof.

The curvature radius ρ1 of the curved surface C1 of the outer connecting surface 22 measured in a vertical plane in the vicinity of the front end of the front side region F of the bowl 10 shown in FIG. 3 is set preferably to 3-20 mm, for example, and most preferably to 5-10 mm.

Also, the curvature radius ρ2 of the curved surface C2 of the outer connecting surface 22 measured in a vertical plane in the vicinity of the left end of the bowl 10 front side region F shown in FIG. 4 is set preferably to 3-20 mm, for example, and most preferably to 5-10 mm.

In addition, the curvature radius ρ3 of the curved surface C3 of the outer connecting surface 22 measured in a vertical plane in the vicinity of the rear end of the rear side region B of the bowl 10 shown in FIG. 5 is set preferably to 5-40 mm, for example, and most preferably to 10-25 mm.

A shelf width W3 of the shelf 6 measured in the vicinity of the rear end of the rear side region B of the bowl 10 shown in FIG. 5 is set smaller than a shelf width W2 (>W3) of the shelf 6 measured in the vicinity of the left end of the front side region F of the bowl 10 shown in FIG. 4. Thus, the widths W2 and W3 of the shelves 6 are set smaller in the rear of the bowl 10 than in the sides thereof.

The shelf width W2 of the shelf 6 measured in the vicinity of the front end of the front side region F of the bowl 10 shown in FIG. 3 is set larger than the shelf width W2 of the shelf 6 measured in the vicinity of the left end of the front side region F of the bowl 10 shown in FIG. 4. The shelf width W2 of the shelf 6 is thus set larger in the front of the bowl 10 than in the side thereof.

The shelf width W2 of the shelf 6 measured in the vicinity of the front end of the front side region F of the bowl 10 shown in FIG. 3 is set preferably to 5-50 mm, for example, and most preferably to 15-30 mm.

Also, the shelf width W2 of the shelf 6 measured in the vicinity of the left end of the front side region F of the bowl 10 shown in FIG. 4 is set preferably to 5-30 mm, for example, and most preferably to 5-20 mm.

In addition, the shelf width W3 of the shelf 6 measured in the vicinity of the rear end of the rear side region B of the bowl 10 is set preferably to 0-20 mm, for example, and most preferably to 0-10 mm.

The curved surface c4 of the inner connecting surface 24 connecting between the top edge 4*a* of the waste receiving surface 4 and the inner edge 6*b* of the shelf 6 is configured to take a curvature radius ρ4 measured in a vertical plane in the vicinity of the front end of the front side region F of the bowl 10 shown in FIG. 3. The curvature radius ρ4 is set preferably to 20-70 mm, for example, and most preferably to 30-50 mm.

The curved surface C5 of the inner connecting surface 24 is configured to take a curvature radius ρ5 measured in a vertical plane in the vicinity of the left end of the front side region F of the bowl 10 shown in FIG. 4. The curvature radius ρ5 is set preferably to 5-35 mm, for example, and most preferably to 5-20 mm.

Also, the curved surface C6 of the inner connecting surface 24 is configured to take a curvature radius ρ6 measured in a vertical plane in the vicinity of the rear end of the rear side region B of the bowl 10 shown in FIG. 5. The curvature radius ρ6 is set preferably to 30-80 mm, for example, and most preferably to 35-55 mm.

Next the operation of the flush toilet 1 according to the above-described first embodiment of the invention will be explained.

First, in the flush toilet 1 according to the first embodiment of the invention, the ratio W1/W2 between the amount W1 of the horizontal overhang protruding further to the inside of the bowl 10 than the bottom end 8*d* of the overhang part 8*c* of the inner wall surface 8*b* measured in the front side region F of the bowl 10, to the shelf width W2, is set equal to 0.2 or greater, and equal to or less than 1.0. Good visibility of the inner wall surface 8*b* from a user positioned in front of and above the bowl 10 can thus be attained. Also, the outer edge 6*a* of the shelf 6 formed in the front side region F of the bowl 10 become less visible, thereby effectively reducing the visibility of the shelf 6.

Therefore, waste is less prone to adhesion to the shelf 6, and the user's perceptional problem that the user may experience a visual discomfort can be eliminated.

In the flush toilet 1 according to the present embodiment, the overhang parts 8*c* of the inner wall surface 8*b* are configured to form the sloped surfaces S1, S2, and S3 sloping from the bottom end 8*d* thereof toward upward, and toward the inside of the bowl 10. Good visibility of the inner wall surface 8*b* from a user positioned in front of and above the bowl 10 can be attained with this configuration. Also, the visibility of the shelf can be more effectively reduced.

Therefore, waste is less prone to adhesion to the shelf 6, and the user's perceptional problem that the user may experience a visual discomfort can be eliminated.

Also, in the flush toilet 1 according to the present embodiment, the sloped surface S1 of the overhang part 8*c* of the rim inside wall surface 8*b* is configured to take the slope angle α1 relative to the vertical face V1 measures largest in the vicinity of the front end within the bowl 10 among those measured around the circumference of the inner wall surface 8*b*. Therefore, the shelf 6 located, in particular, in the vicinity of the front end of the bowl 10 becomes less visible.

Also, urine, when striking the inner wall surface 8*b* located in the vicinity of the front end of the bowl 10 interior, where urine is likely to strike, will be prevented from running up the sloped surface S1 of the overhang part 8*c* of the inner wall surface 8*b* and splashing outside of the bowl 10.

In addition, since the sloped surface S1 of the inner wall surface 8*b* of the overhang part 8*c* is configured to take the slope angle α1 that is largest in the vicinity of the front end inside the bowl 10, the sloped surface S1 facilitates gripping of the flush toilet 1 when the flush toilet 1 is installed, for example, thereby improving the installability of the flush toilet.

In the flush toilet 1 according to the present embodiment, the curved surface C3 of the outer connecting surface 22 connecting between the outer edge 6*a* of the shelf 6 and the bottom end 8*a* of the rim 8 is configured to take the curvature radius ρ3 measured in a vertical plane in the vicinity of the rear end of the rear side region B of the bowl 10 shown in FIG. 5, and the curvature radius ρ3 is set larger than the curvature radius ρ2 (<ρ3) of the curved surface C2 of the outer connecting surface 22 measured in a vertical plane in the vicinity of the left end of the front side region F of the bowl 10 shown in FIG. 4. Also, the curvature radii ρ2, ρ3 of the curved surfaces C2, C3 of the outer connecting surface 22 are set larger than in the rear of the bowl 10 than in the side thereof. With this configuration, the outer connecting surface 22, which constitutes the boundary between the outer edge 6*a* of the shelf 6 located rearward from the sides of the bowl 10 and the bottom end 8*a* of the inner wall surface 8*b*, can be made less noticeable from a user positioned in front of and above the bowl 10.

Therefore, the inner wall surface 8*b* located in the back of the bowl 10 becomes more visible than that located in the sides thereof.

Also, in the flush toilet 1 according to the present embodiment, the shelf width W3 of the shelf 6 measured in the vicinity of the rear end of the rear side region B of the bowl 10 shown in FIG. 5 is set smaller than the shelf width W2 (>W3) of the shelf 6 measured in the vicinity of the left end of the front side region F of the bowl 10 shown in FIG. 4. Also, the widths W2 and W3 of the shelf 6 are set smaller in the rear than in the side of the bowl 10. With this configuration, the presence of the shelf 6 on the back of the bowl 10 can be made less conspicuous from a user positioned in front of and above a bowl 10.

Therefore, the inner wall surface 8*b* is made more visible in the back of the bowl 10 than in the sides thereof. Also, waste is less prone to adhesion to the shelf 6 located rearward from the sides of the bowl 10, and the user's perceptional problem that the user may experience a visual discomfort can be eliminated.

In the flush toilet 1 according to the present embodiment, the shelf width W2 of the shelf 6 measured in the vicinity of the front end of the front side region F of the bowl 10 shown in FIG. 3 is set larger than the shelf width W2 of the shelf 6 measured in the vicinity of the left end of the front side region F of the bowl 10 shown in FIG. 4. Also, the shelf width W2 of the shelf 6 is set larger in the front of the bowl 10 than in the side thereof. Good visibility of the inner wall surface 8*b* from a user positioned in front of and above the bowl 10 can be attained with this configuration. Also, the shelf 6 can be made less visible in the front of the bowl 10 than in the sides thereof, thus making the shelf 6 less noticeable.

Therefore, waste is less prone to adhesion to the shelf 6, and the user's perceptional problem that the user may experience a visual discomfort can be eliminated.

Next, referring to FIGS. 6 and 7, a flush toilet according to the second embodiment of the invention will be explained.

Figure 6:
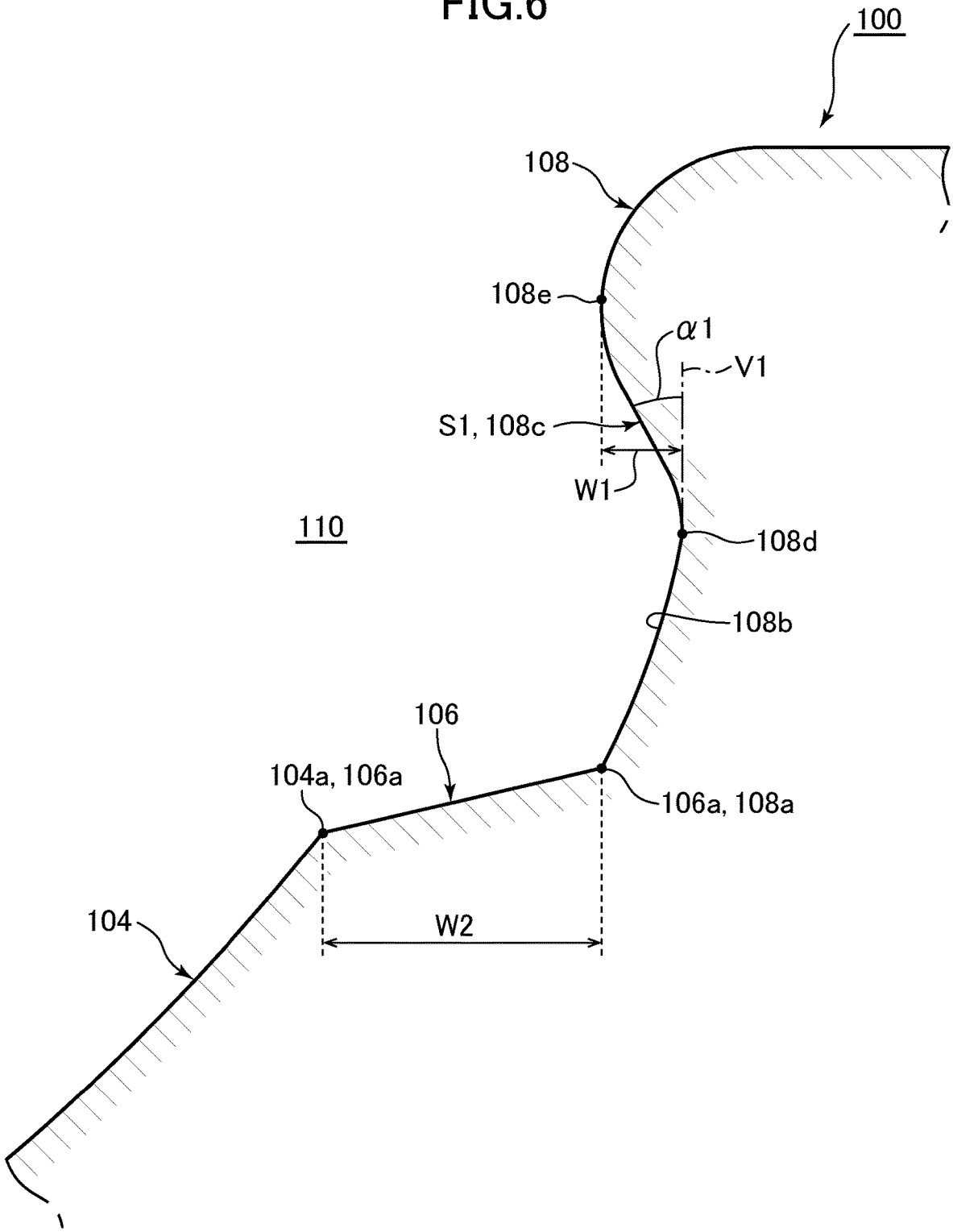
FIG. 6 is a cross section taken in a similar fashion as FIG. 3 is taken, which is taken in the vicinity of the front edge of the bowl of a flush toilet according to the second embodiment of the invention.

FIG. 6 is a cross section taken in a similar fashion as FIG. 3 is taken in the vicinity of the front edge of the bowl and showing the flush toilet according to the second embodiment of the invention. FIG. 7 is a cross section taken in a similar fashion as FIG. 4 is taken in the vicinity of the left edge of the bowl and showing the flush toilet according to the second embodiment of the invention.

Figure 7:
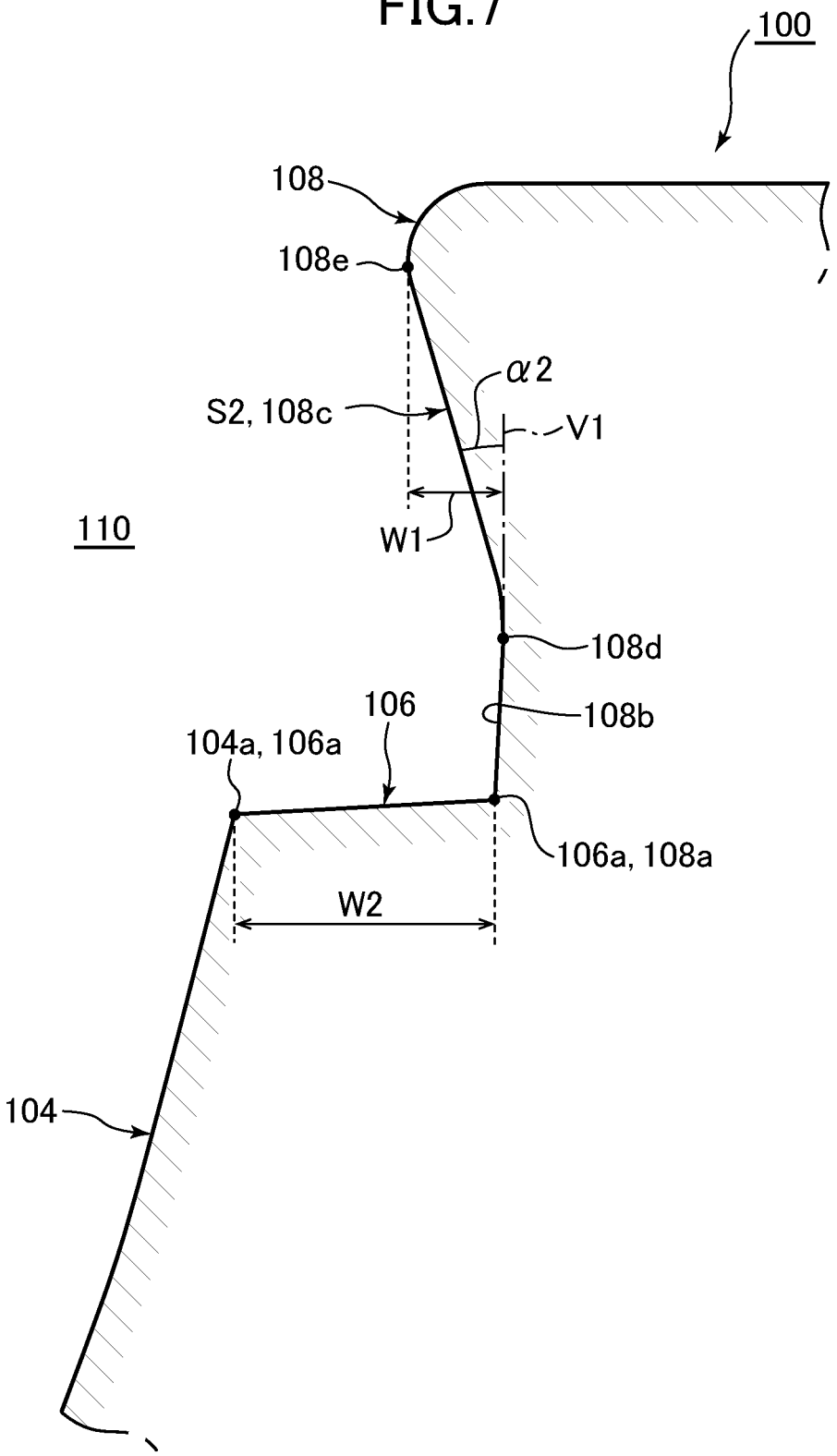
FIG. 7 is a cross section taken in a similar fashion as FIG. 4 is taken, which is taken in the vicinity of the left edge of the bowl of the flush toilet according to the second embodiment of the invention.

In a flush toilet 100 according to the second embodiment of the invention shown in FIGS. 6 and 7, the same reference numerals are used to identify the same parts of the flush toilet 1 according to the first embodiment of the invention shown in FIGS. 1-5, and an explanation thereof is omitted.

As shown in FIGS. 6 and 7, the flush toilet 100 according to the second embodiment of the invention is different from the flush toilet 1 according to the above-described first embodiment in that the bowl 110 includes another connecting surface different from the outer connecting surface 22 or the inner connecting surface 24 of the bowl 10 of the flush toilet 1 according to the first embodiment of the invention.

That is, in the flush toilet 100 according to the present embodiment, the shelf 106 and the rim 108 comprise an outer edge 106*a* and the bottom end 108*a*, respectively, which are connected to each other without a curved surface connecting between them. Also, the waste receiving surface 104 and the shelf 106 comprise the top edge 104*a* and the inner edge 106*b*, respectively, which are connected to each other without a curved surface connecting between them.

As shown in FIGS. 6 and 7, in the flush toilet 100 according to the second embodiment of the invention, an amount W1 of the horizontal overhang measured from the bottom end 108*d* to the inner edge 108*e* of the overhang part 108*c* in the vicinity of the front end of the front side region F of the bowl 110 shown in FIG. 6 is set, for example, equal to 10 mm.

Similarly, an amount W1 of the horizontal overhang measured from the bottom end 108*d* of the overhang part 108*c* to the inner edge 108*e* in the vicinity of the left end of the front side region F of the bowl 110 shown in FIG. 7 is set, for example, equal to 10 mm.

A width W2 of the horizontal shelf measured from the inner edge 106*b* to the outer edge 106*a* of the shelf 106 in the front end of the front side region F in the bowl 110 shown in FIG. 6 is set, for example, equal to 33 mm. Also, the width W2 of the horizontal shelf measured from the inner edge 106*b* to the outer edge 106*a* of the shelf 106 in the vicinity of the left end of the front side region F in the bowl 110 shown in FIG. 7 is set, for example, equal to 25 mm.

Therefore, the ratio W1/W2 of the overhang amount W1 measured in the vicinity of the front end of the front side region F of the bowl 110 shown in FIG. 6 to the shelf width W2 is, for example, 0.3. Also, the ratio W1/W2 of the overhang amount W1 measured in the vicinity of the left end of the front side region F of the bowl 110 shown in FIG. 7 to the shelf width W2 is, for example, 0.4.

Note that in the present embodiment, the ratio W1/W2 of the overhang amount W1 measured in the front side region F of the bowl 110 to the shelf width W2 is set, for example, preferably to 0.2 or greater and 1.0 or less, and most preferably to 0.2-0.5.

In the flush toilet 100 according to the present embodiment, as with the flush toilet 1 according to the above-described first embodiment, a sloped surface S1 of the overhang part 108*c* is set in the vicinity of the front end of the front side region F of the bowl 110 shown in FIG. 6 so that a slope angle α1 relative to the vertical face V1 thereof is largest in the vicinity of the front end inside the bowl 110 among those measured throughout the circumference of the inner wall surface 108*b*.

That is, the slope angle α1 of the slope surface S1 of the overhang part 108*c* measured in the vicinity of the front end of the front side region F of the bowl 110 shown in FIG. 6 is set larger than a slope angle α2 (<α1) of a sloped surface S2 of the overhang part 108*c* measured in the vicinity of the left end of the front side region F of the bowl 110 shown in FIG. 7.

In the flush toilet 100 according to the present embodiment, as with the flush toilet 1 of the above-described first embodiment, a shelf width W2 (e.g., W2=34.5 mm) of the shelf 106 measured in the vicinity of the front end of the front side region F of the bowl 110 shown in FIG. 6 is set larger than a shelf width W2 (e.g., W2=27.4 mm) measured in the vicinity of the left end of the front side region F of the front side region F of the bowl 110 shown in FIG. 7. The shelf width W2 of the shelf 106 is set larger in the front of the bowl 110 than in the side thereof.

The shelf width W2 of the shelf 106 measured in the vicinity of the front end of the front side region F of the bowl 110 shown in FIG. 6 is set preferably to 10 mm-1000 mm, for example, and most preferably to 20 mm-50 mm.

The shelf width W2 of the shelf 106 measured in the vicinity of the front end of the front side region F of the bowl 110 shown in FIG. 7 is set preferably to 10 mm-50 mm, for example, and most preferably to 15 mm-30 mm.

In the flush toilet 100 according to the above-described second embodiment of the invention, the ratio W1/W2 between the horizontal overhang amount W1 protruding further to the inside of the bowl 110 than the bottom end 108*d* of the overhang part 108*c* of the inner wall surface 108*b* in the front side region F of the bowl 110, to the shelf width W2, is set at 0.2 or greater, and equal to or less than 1.0. Good visibility of the inner wall surface 108*b* from a user positioned in front of and above the bowl 110 can thus be attained. Also, the outer edge 106*a* of the shelf 106 located in the front side region F of the bowl 110 can be made less noticeable, thereby reducing the visibility of the shelf 106.

Therefore, waste is less prone to adhesion to the shelf 106, and the user's perceptional problem that the user may experience a visual discomfort can be eliminated.

In the flush toilet 100 according to the present embodiment, good visibility of the inner wall surface 108*b* can be attained, and the shelf 106 can be less noticeable from a user positioned in front of and above a bowl 110.

Also, waste is less prone to adhesion to the shelf 106, and the user's perceptional problem that the user may experience a visual discomfort can be eliminated.

Urine, when striking the inner wall surface 108*b* located in the vicinity of the front end of the bowl 110 interior, where urine is likely to strike, will be prevented from running up the sloped surface S1 of the overhang part 108*c* of the inner wall surface 108*b* and splashing to the outside of the bowl 110.

Since the sloped surface S1 of the overhang part 108*c* of the inner wall surface 108*b* is configured to take the slope angle α1 which is largest in the vicinity of the front end inside the bowl 110, the slope surface S1 facilitates gripping of the flush toilet when the flush toilet 100 is installed, for example, thereby improving the installability of the flush toilet.

Moreover, in the flush toilet 100 according to the present embodiment, the shelf width W2 of the shelf 106 measured in the vicinity of the front end of the front side region F of the bowl 110 shown in FIG. 6 is set larger than the shelf width W2 of the shelf 106 measured in the vicinity of the left end of the front side region F of the bowl 110 shown in FIG. 7. The shelf width W2 of the shelf 106 is set larger in the front of the bowl 110 than in the sides thereof. Good visibility of the inner wall surface 108*b* from a user positioned in front of and above the bowl 110 can thus be attained. Also, the shelf 106 can be made less visible in the front of the bowl 110 than in the sides thereof, thus making the shelf 106 less noticeable.

Therefore, waste is less prone to adhesion to the shelf 106, and the user's perceptional problem that the user may experience a visual discomfort can be eliminated.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied from a flush water source, the flush toilet comprising:

a bowl including a bowl-shaped waste receiving surface, a shelf formed above the waste receiving surface, an inner connecting surface between a top edge of the waste receiving surface and an inner edge of the shelf, and an outer connecting surface extending outward from an outer edge of the shelf, and a rim including an inner wall surface configured to rise from an outer edge of the outer connecting surface; and a rim spout portion configured to spout the flush water onto the shelf in the bowl, wherein the bowl includes a front side region and a rear side region, the front side region being formed on a front side of a center axis extending horizontally in a left-right direction of the bowl so as to divide the bowl equally in a front-rear direction of the bowl, the rear side region being formed on a rear side of the center axis, the inner wall surface includes an overhang part configured to protrude toward inside of the bowl, in horizontal plan view of the bowl, a shelf surface area on the front side region of the bowl is smaller than a waste receiving surface area on the front side region of the bowl, a first curvature radius (ρ4) of a first curved surface (C4) of the inner connecting surface in a vertical plane in a front end of the front side region of the bowl is larger than a second curvature radius (ρ1) of a second curved surface (C1) of the outer connecting surface in the vertical plane in the front end of the front side region of the bowl, and a bottom end of the overhang part is located outside the outer edge of the shelf, and the shelf is shaped to have a width (W2) measured in a horizontal direction at a location in the front side region, and the overhang part is shaped to protrude for an amount (W1) measured in the horizontal direction at said location in the front side region, wherein a ratio (W1/W2) between the amount (W1) and the width (W2) is set smaller than 1.0, wherein the overhang part of the inner wall surface includes a sloped surface configured to slope from the bottom end of the overhang part toward an innermost portion of the overhang part at front and rear ends of the bowl, the sloped surface having a slope angle relative to a vertical plane, and wherein the slope angle of the sloped surface at the front end of the bowl is larger than the slope angle of the sloped surface at the rear end of the bowl.

2. The flush toilet according to claim 1, wherein the slope angle at the front end of the bowl is larger than the slope angle at other locations in a circumference of the bowl.

3. The flush toilet according to claim 1, wherein the ratio (W1/W2) is set to 0.2 or more and smaller than 1.0.

4. A flush toilet configured to discharge waste by flushing the flush toilet with flush water supplied from a flush water source, the flush toilet comprising:

a bowl including a bowl-shaped waste receiving surface, a shelf formed on a top edge of the waste receiving surface, a connecting surface extending outward from an outer edge of the shelf, and a rim including an inner wall surface configured to rise from an outer edge of the connecting surface; and a rim spout portion configured to spout the flush water onto the shelf in the bowl, wherein the bowl includes a front side region and a rear side region, the front side region being formed on a front side of a center axis extending horizontally in a left-right direction of the bowl so as to divide the bowl equally in a front-rear direction of the bowl, the rear side region being formed on a rear side of the center axis, the inner wall surface includes an overhang part configured to protrude toward inside of the bowl, and the shelf is shaped to have a width (W2) measured in a horizontal direction at a location in the front side region, and the overhang part is shaped to protrude for an amount (W1) measured in the horizontal direction at said location in the front side region, wherein a ratio (W1/W2) between the amount (W1) and the width (W2) is set smaller than 1.0, and wherein the bowl comprises a pair of side regions arranged in the left-right direction of the bowl, and the connecting surface is a curved surface between the outer edge of the shelf and a bottom end of the inner wall surface of the rim, the curved surface having a curvature radius measured in a vertical plane, the curvature radius being set larger in the rear side region of the bowl than the curvature radius in the side regions of the bowl.

5. The flush toilet according to claim 4, wherein the width (W2) of the shelf is set smaller in the rear side region of the bowl than the width (W2) of the shelf in the side regions of the bowl.

6. The flush toilet according to claim 4, wherein the width (W2) of the shelf is set larger in the front side regions of the bowl than the width (W2) of the shelf in the side regions of the bowl.

* * * * *